US005997371A

United States Patent [19]

Oishi

[11] Patent Number: 5,997,371

[45] Date of Patent: Dec. 7, 1999

[54] CHOKE CONTROL FOR OUTBOARD MOTOR ENGINE

[75] Inventor: Hiroshi Oishi, Hamamatsu, Japan

[73] Assignee: Sanshin Kogyo Kabushiki Kaisha, Hamamatsu, Japan

[21] Appl. No.: 08/978,720

[22] Filed: Nov. 26, 1997

[30] Foreign Application Priority Data

Nov. 28, 1996 [JP] Japan ..... 8-317814

[51] Int. Cl.[6] ..... B63H 20/32

[52] U.S. Cl. ..... 440/77; 440/84; 440/88; 440/900

[58] Field of Search ..... 440/1, 2, 88, 89, 440/84, 900, 90, 77

[56] References Cited

U.S. PATENT DOCUMENTS 2,351,050 6/1944 Karey ..... 440/88

4,677,944 7/1987 Nishimura et al. .

4,788,014 11/1988 Kanno .

5,489,227 2/1996 Ishida et al. ..... 440/88

*Primary Examiner*—Stephen Avila

*Attorney, Agent, or Firm*—Knobbe, Martens, Olson & Bear LLP

[57] ABSTRACT

A choke control for an outboard motor having a cowling, a water propulsion device and an internal combustion engine positioned in the cowling and arranged to propel the water propulsion device is disclosed. The engine has at least one combustion chamber and an intake system including an intake pipe extending along a side of the engine for providing air to the combustion chamber. A choke control is provided for actuating a choke valve associated with the intake pipe. The choke control includes a choke actuator which is positioned exterior to the cowling and supported by a mount associated with the cowling, the choke actuator connected to the choke valve via a choke linkage which is positioned within the cowling generally above the intake pipe.

15 Claims, 9 Drawing Sheets

CHOKE CONTROL FOR OUTBOARD MOTOR ENGINE

FIELD OF THE INVENTION

The present invention relates to an outboard motor. More particularly, the invention is a choke control arrangement for an engine powering an outboard motor.

BACKGROUND OF THE INVENTION

Watercraft are often powered by an outboard motor positioned at a stem of the craft. The outboard motor has a powerhead and a water propulsion device, such as a propeller. The powerhead includes a cowling in which is positioned an internal combustion engine, the engine having an output shaft arranged to drive the water propulsion device.

In many instances, the engine includes a manually operated choke mechanism. The choke mechanism may comprise a butterfly-type valve movably mounted in an intake pipe of the intake system. A choke control is provided for moving the valve. When the engine is cold, it is desirable to close the choke valve to increase the ratio of fuel to air for starting the engine. In many instances, however, the choke control is positioned in a rather inaccessible location. The powerhead of an outboard motor may be positioned some distance beyond the hull of the watercraft. Often, the motor is arranged to be readily removable from the watercraft, and so does not include a remotely controllable choke control which permits actuation of the choke valve from within the watercraft. Instead, the choke control may be positioned along a side of the motor or other inaccessible location, requiring the operator of the motor to lean over the water beyond the stem of the watercraft to manipulate the choke.

A choke control associated with an engine powering an outboard motor which overcomes the above-stated problems is desired.

SUMMARY OF THE INVENTION

The present invention is a choke control for an engine of an outboard motor. Preferably, the motor is of the type having a cowling and a water propulsion device. The internal combustion engine is positioned in the cowling and arranged to propel the water propulsion device.

The engine has at least one combustion chamber. An intake system provides air to the combustion chamber and includes an intake pipe extending along a side of the engine.

A choke valve is associated with the intake pipe. A choke control is provided for actuating the choke valve. The choke control includes a choke actuator which is positioned exterior to the cowling and supported by a mount connected to the cowling and which faces the watercraft, the choke actuator connected to the choke valve via a choke linkage which is positioned within the cowling generally above the intake pipe.

In the preferred embodiment, the mount supports a starter handle of a re-coil starter mechanism of the motor. Preferably, the choke actuator comprises a knob, the knob connected to a choke rod which extends therefrom into the interior of the cowling to a connector. A linkage extends from the connector to a choke valve lever connected to the choke valve. In this arrangement, the choke rod and linkage are offset from one another.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is choke control for an engine of the type utilized to power a water propulsion device of an outboard motor and positioned in a cowling of the motor. The engine arranged in accordance with the present invention is described for use with an outboard motor since this is an application for which the engine as arranged has particular utility. Those of skill in the art will appreciate that an engine as arranged in accordance with the present invention may be used in a variety of other applications.

Figure 1:
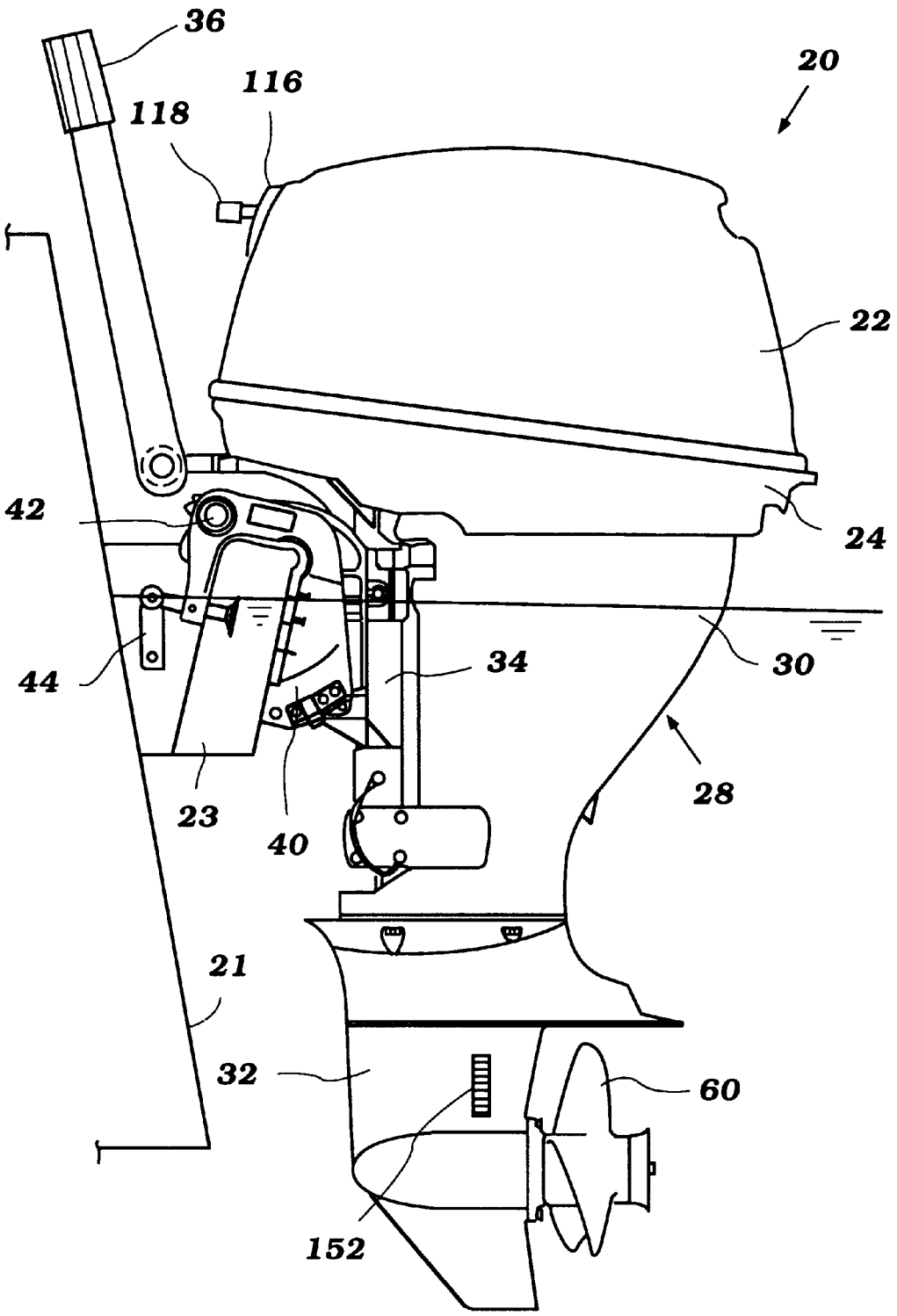
FIG. 1 is a side view of an outboard motor of the type utilized to propel a watercraft, the motor powered by an engine having a choke control in accordance with the present invention.
Figure 2:
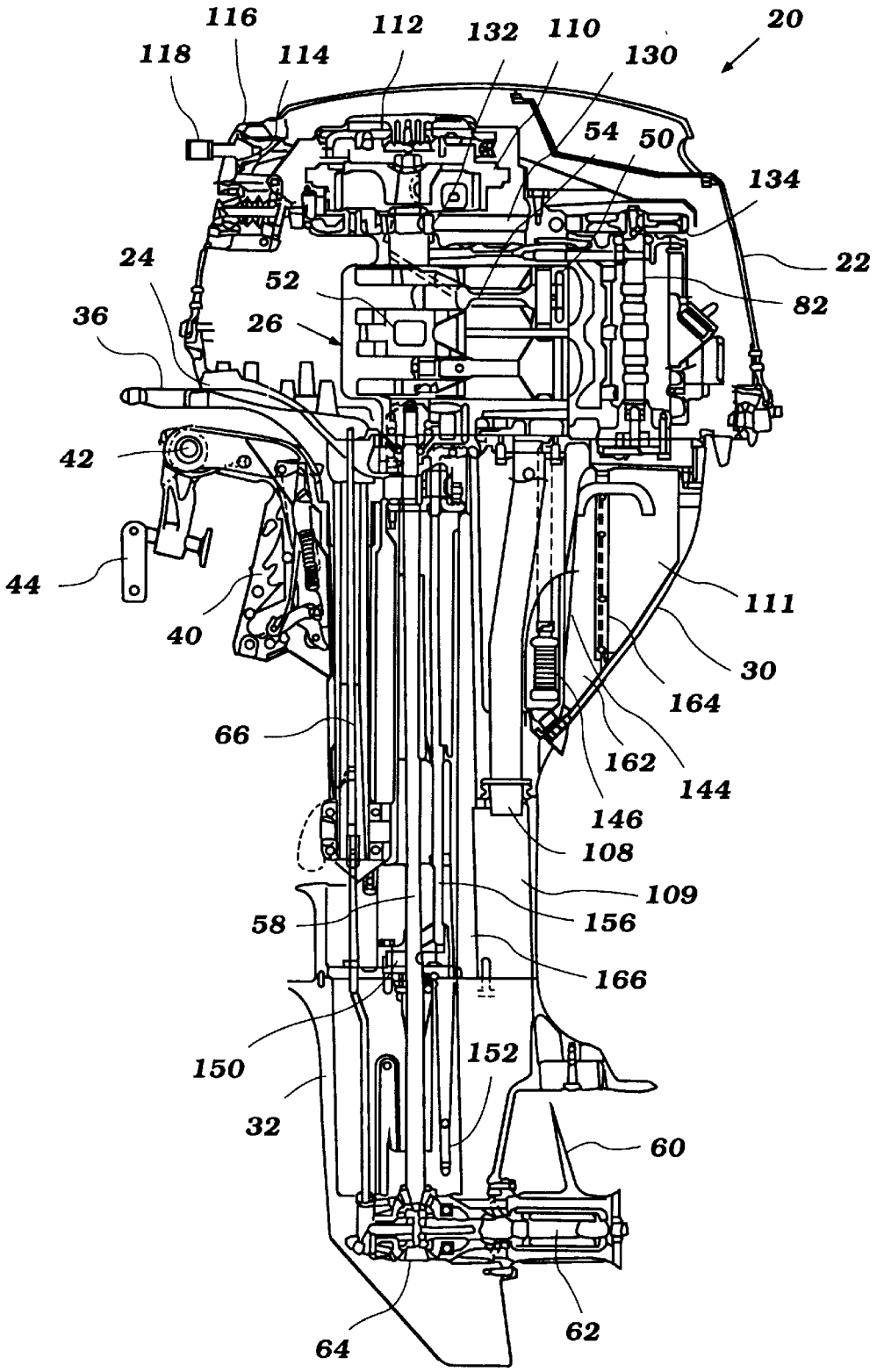
FIG. 2 is a cross-sectional side view of the motor illustrated in FIG. 1.

FIG. 1 illustrates an outboard motor 20 of the type with which the present invention is useful. The outboard motor 20 has a powerhead comprising a main cowling 22 with a lower cowling or tray 24 positioned therebelow. As illustrated in FIG. 2 and described in more detail below, an internal combustion engine 26 is positioned in the powerhead.

A drive shaft housing or lower unit 28 depends below the powerhead. The drive shaft housing 28 comprises an upper casing 30 and a lower casing 32 positioned below the upper casing.

The outboard motor 20 is arranged to be movably connected to a hull of a watercraft 21, preferably at a transom portion 23 of the watercraft at a stern thereof. In this regard, a steering shaft (not shown) is connected to the drive shaft housing 28 portion of the motor 20. The steering shaft preferably extends along a vertically extending axis through a swivel bracket 34. The mounting of the steering shaft with respect to the swivel bracket 34 permits rotation of the motor 20 about the vertical axis through the bracket 34, so that the motor may be turned from side to side.

A steering handle 36 is connected to the bracket 34. An operator of the motor 20 may move the outboard motor 20 from side to side with the handle 36, thus steering the watercraft to which the motor is connected.

The swivel bracket 34 is connected to a clamping bracket 40 by means of a pivot pin 42 which extends along a generally horizontal axis. The clamping bracket 40 is arranged to be removably connected to the hull of the watercraft 21 with a clamping screw 44 or similar mechanism. The mounting of the motor 20 with respect to the clamping bracket 40 about the pin 42 permits the motor 20 to be raised up and down or "trimmed."

As described above, an engine 26 is positioned in the powerhead. The engine 26 is preferably of the two-cylinder variety, arranged in in-line fashion and operating on a four-cycle principle. As may be appreciated by those skilled in the art, the engine 26 may have a greater or lesser number of cylinders, may be arranged in other than in-line fashion and may operate on other operating principles, such as a two-cycle principle.

Figure 4:
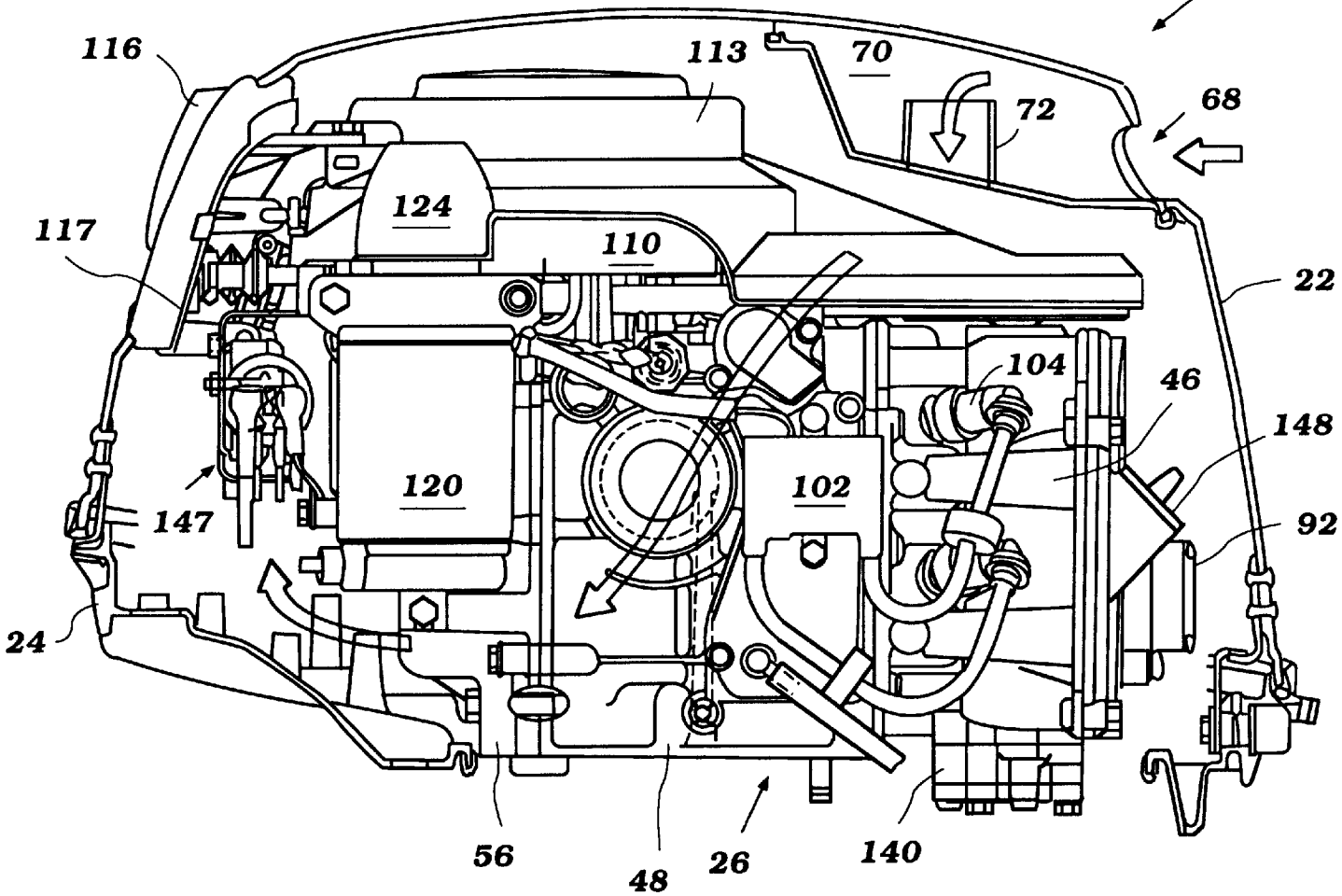
FIG. 4 is an enlarged cross-sectional view of a first side of a top portion of the motor illustrated in FIG. 1.

Referring to FIGS. 2 and 4, the engine 26 preferably comprises a cylinder head 46 connected to a cylinder block 48 and cooperating therewith to define two cylinders. A piston 50 is movably positioned in each cylinder 48 and connected to a crankshaft 52 via a connecting rod 54.

As best illustrated in FIG. 2, the crankshaft 52 is generally vertically extending. As such, the cylinders, and thus the pistons 48, extend in a horizontal direction. The crankshaft 52 is mounted for rotation with respect to the remainder of the engine 26 within a crankcase chamber defined by the cylinder block 48 and a crankcase cover 56 connected thereto. As illustrated, the crankcase cover 56 is positioned at the opposite end of the cylinder block 48 from the cylinder head 46. Preferably, the cylinder head end of the engine 26 is positioned within the main cowling 22 farthest from the watercraft 21 when the motor 20 is attached thereto, and the crankcase end of the engine 26 is thus closest to the watercraft when the motor 20 is attached thereto.

The crankshaft 52 extends below a bottom of the engine 26 in the direction of the drive shaft housing 28, where it is coupled to a drive shaft 58. The drive shaft 58 extends through the drive shaft housing 28 and is arranged to drive a water propulsion device of the motor 20. As illustrated, the water propulsion device is a propeller 60.

In the preferred arrangement, the drive shaft 58 is arranged to selectively drive a propeller shaft 62 through a forward-neutral-reverse transmission 64. The propeller 60 is connected to an end of the propeller shaft 62 opposite the transmission 64. Preferably, the position of the transmission 64 is controlled by a shift rod 66 extending through the drive shaft housing 28 to the transmission 64 from a transmission control (not shown) which the operator of the motor 20 manipulates.

An intake system provides air to each cylinder of the engine 26 for the combustion process. As illustrated in FIG. 4, air is drawn through a vent 68 in the main cowling 24 into an inlet area 70 formed by the main cowling 24. Air then flows through an upwardly extending air inlet pipe 72 into the interior of the cowling in which the engine 26 is positioned. The above-described arrangement serves to reduce the flow of water and the like through the vent 68 into the portion of the cowling 22 which houses the engine 26. In the preferred embodiment, a similar intake pipe 73 leads from the inlet area 70 into the engine compartment on the opposite side of the cowling 22 (see FIG. 3).

Figure 3:
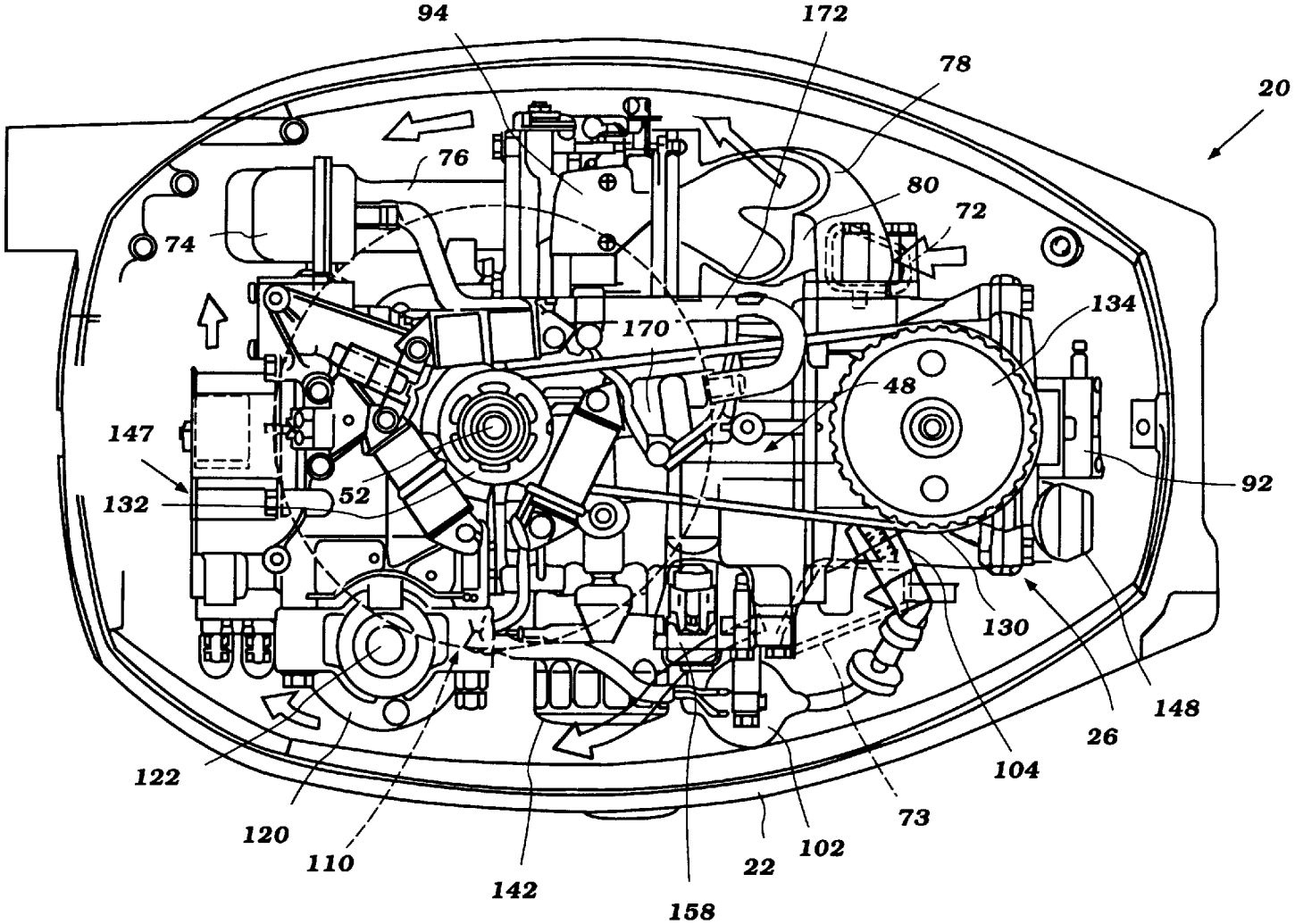
FIG. 3 is a top view of the motor illustrated in FIG. 1 with a main cowling and a flywheel cover removed, exposing a top end of the engine.
Figure 5:
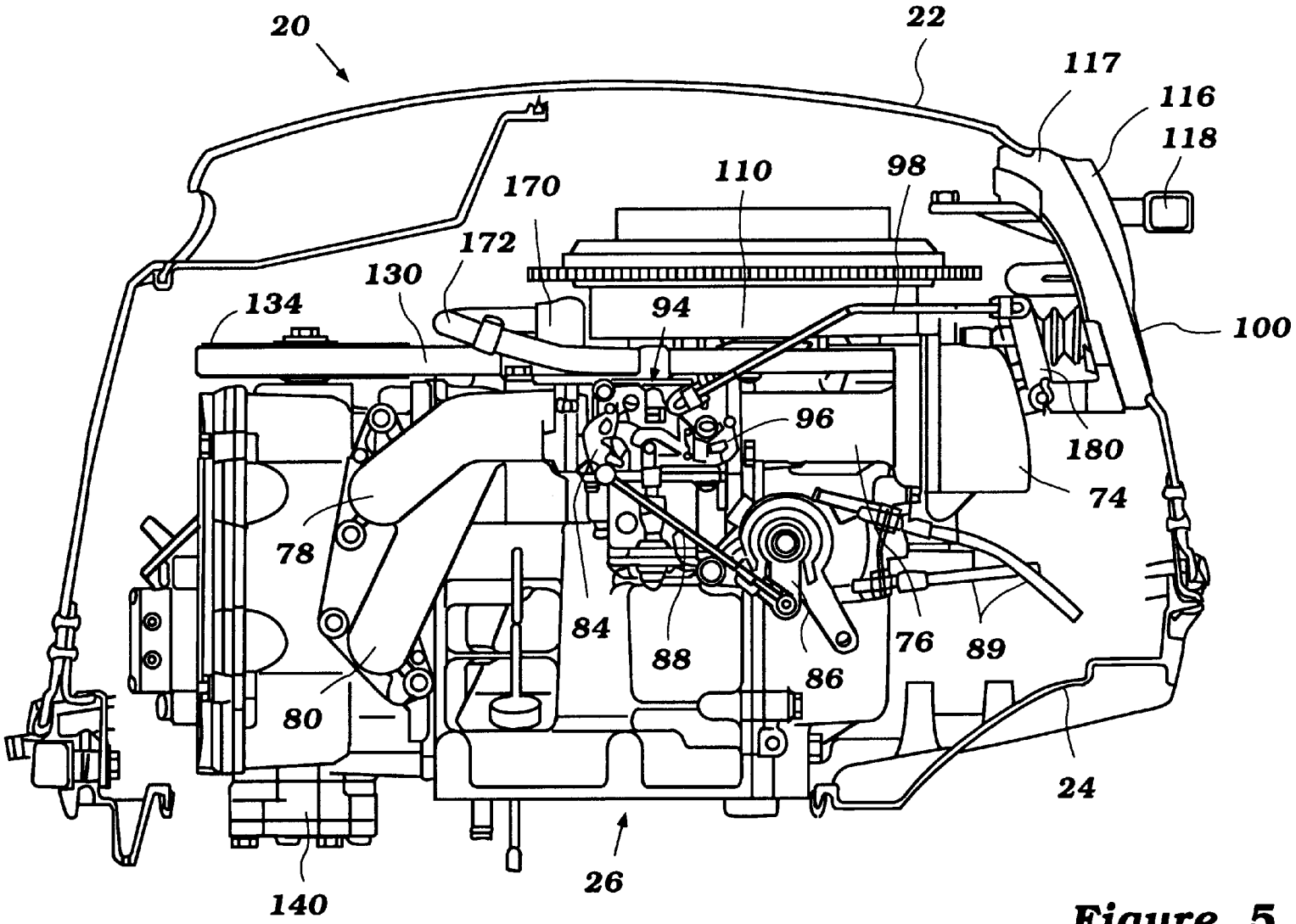
FIG. 5 is an enlarged cross-sectional view of a second side of a top portion of the motor illustrated in FIG. 1 and with a flywheel cover of the engine removed.
Figure 7:
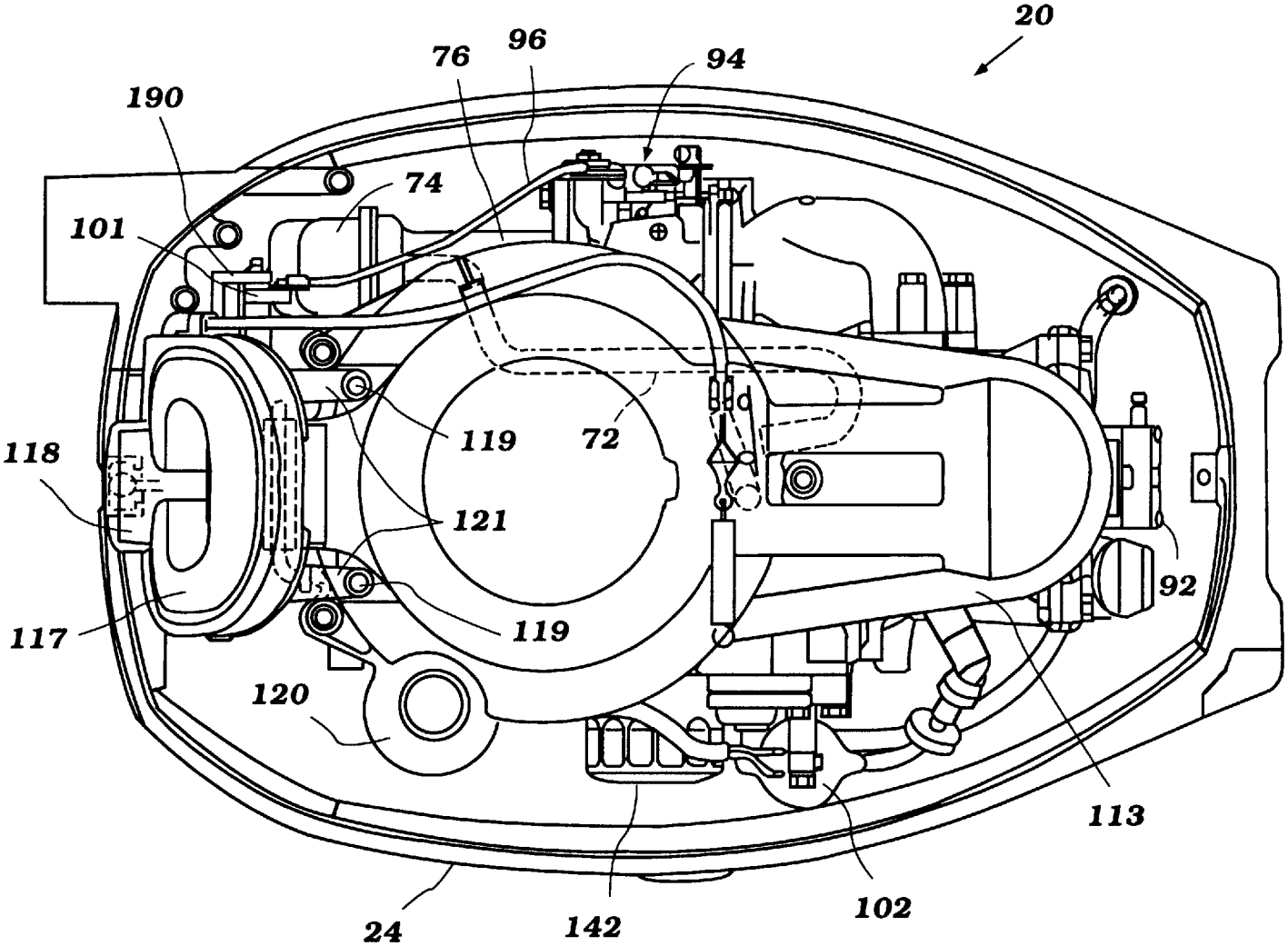
FIG. 7 is a top view of the motor illustrated in FIG. 1, with a portion of a main cowling removed, exposing the engine therein.

Referring now to FIGS. 3, 5 and 7, air within the main cowling 22 is drawn into a silencer 74. The air is then drawn from the silencer 74 through an intake pipe 76 to a pair of branch pipes 78,80. The branch pipes 78,80 are connected to the cylinder head 46 of the engine 26 and each have a passage therethrough aligned with a corresponding passage through the cylinder head 46 leading to one of the cylinders. In this manner, air flows through the intake pipe 76 and respective branch pipes 78,80 to each cylinder.

In the embodiment illustrated, the intake pipe 76 and branch pipes 78,80 preferably extend along a first side of the engine 26 from the crankcase chamber end towards the cylinder head end, generally below a top of the engine.

Preferably, means are provided for controlling the flow of air into each cylinder in a timed manner. Though not illustrated, this means may comprise an intake valve positioned in each intake passage leading through the cylinder head 46 to a cylinder. In such an arrangement, each intake valve is preferably actuated between open and closed positions, as known to those of skill in the art, by at least one camshaft 82 (see FIG. 1).

Means are also provided for controlling the rate of air flow through the intake system to each cylinder. Preferably, this means comprises a throttle valve (not shown) positioned in the intake pipe 76. Referring to FIG. 5, the throttle valve is preferably actuated by a throttle lever 84. This lever 84 is connected to a pivot lever 86 via a throttle link 88. A throttle actuator wire 89 is connected to the pivot lever 86 for moving the pivot lever 86, the wire 89 extending to an operator-engaged throttle control (not shown) of a type well known to those skilled in the art.

A fuel system provides fuel to each cylinder for combustion with the air. The fuel system draws fuel from a fuel supply (not shown) such as a fuel tank positioned in the hull of the watercraft 21 to which the motor 20 is connected. Preferably, as illustrated in FIG. 4, the fuel is drawn by a fuel pump 92. The fuel pump 92 delivers the fuel through a fuel line to a charge former. In the preferred embodiment, the charge former comprises a carburetor 94.

As illustrated, the carburetor 94 is positioned along the intake pipe 76 for introducing fuel into the air passing therethrough. In this manner, a combined air and fuel charge is delivered through the branch pipes 78,80 to the cylinders. Though not described herein, those of skill in the art will appreciate that other charge formers such as fuel injectors may be used. In addition, a carburetor may be provided corresponding to an intake pipe leading to each cylinder instead of a single carburetor for all cylinders as in the illustrated embodiment.

The carburetor 94 is preferably arranged so that the movement of the throttle lever 84 effectuates a change in the rate of air and fuel delivery, as is known to those of skill in the art.

Preferably, a choke is associated with the intake system, and more particularly, the carburetor 94, as described in greater detail below.

The engine 26 includes an ignition system. Such systems are well known to those of skill in the art, and thus the system is not described in detail herein. Preferably, however, the system includes a powered ignition coil 102 which delivers a charge at a predetermined time to a spark plug 104 corresponding to each cylinder. Each spark plug 104 has its tip positioned in the cylinder, and when the charge is delivered to the spark plug, effects a spark across an electrode tip thereof to initiate the combustion of the air and fuel mixture in the cylinder.

Referring to FIGS. 2 and 3, an exhaust system is provided for routing exhaust from each cylinder. Preferably, an exhaust passage (not shown) leads through the cylinder head 46 from each cylinder. Each passage leads to a passage through an exhaust manifold 106 connected to the cylinder head 46. Preferably, the manifold 106 is arranged to route exhaust gases to an exhaust pipe 108 which extends below the engine 26 into the drive shaft housing 28. The exhaust pipe 108 terminates in a first expansion chamber or muffler 115. When the engine speed is low and the exhaust back-pressure is low, the exhaust is preferably routed to a second expansion chamber 111 and then through an above the water exhaust gas discharge. When the engine speed is higher and the exhaust pressure is high, the exhaust is preferably routed from the expansion chamber 115 through a through-the-hub (of the propeller) discharge into the body of water in which the motor 20 is operating.

As with the intake system, valve means are preferably provided corresponding to each cylinder for controlling the flow of exhaust therefrom. Although not illustrated, these means may comprise an exhaust valve associated with each cylinder and movable between one position in which exhaust is permitted to flow through the exhaust passage therefrom, and a second position in which the exhaust is not permitted to flow from the cylinder. The same camshaft 52 which is used to control the intake valves may be used to control the exhaust valves. Alternatively, and as known to those of skill in the art, a separate exhaust camshaft may be provided for actuating only the exhaust valves.

A starter mechanism is provided for use in starting the engine 26. Referring to FIGS. 2 and 4, the starter mechanism preferably includes a recoil type starter. In this arrangement, the crankshaft 52 extends above a top end of the engine 26. A flywheel 110 is connected to the portion of the crankshaft 52 extending above the engine 26.

A recoil starter mechanism 112 of a type known to those of skill in the art is preferably associated with the flywheel 110. The recoil starter mechanism 112 is positioned above the flywheel 110, but under a starter mechanism/flywheel cover 113.

A starter cord 114 extends from the recoil mechanism through a combination cord guide and mount 116 which extends through the main cowling 22. This mount 116 is positioned at the end of the motor 20 which faces the watercraft 21 and which is thus closest thereto. A seal 117 is preferably provided between the cord guide 116 and the cowling 22 for providing an air and water tight seal therebetween.

A handle 118 is connected to the end of the cord 114 which extends through the guide 116. In this arrangement, when the operator of the watercraft pulls on the handle 118 and extends the cord 114, the flywheel 110 is rotated, starting the engine 26.

When this type of starting mechanism is employed, the ignition system preferably includes a magneto-type generator which generates power for powering the ignition coil 102 without the need for a battery.

As best illustrated in FIG. 7, the combination guide and mount 116 and recoil mechanism cover 113 are connected securely to one another through a pair of bolts 119. The bolts 119 extend through a pair of spaced flanges 121 extending from the guide 116 towards the cover 113, and into the cover 113 itself.

The motor 20 may also be provided with an electrically powered starter motor 120 for those instances where a battery is available. Referring to FIGS. 3 and 4, the starter motor 120 is preferably mounted along a side of the engine 26 with a pinion gear 122 arranged to drive the flywheel 110. A cover 124 is mounted over the pinion gear 122.

When an electric starter 120 is provided, a starter button 125 is preferably mounted to the mount 116 on the exterior of the main cowling 22, near the handle 118.

Means are provided for driving the camshaft 82. As illustrated in FIG. 2, the camshaft 82 is preferably driven by the crankshaft 52 by means of a flexible transmitter such as a chain or belt 130. A drive pulley 132 is connected to the portion of the crankshaft 52 which extends above the top end of the engine 26. Preferably, the drive pulley 132 is mounted below the flywheel 110. A driven pulley 134 is connected to an end of the camshaft 82 also extending above the top end of the engine. The drive belt 130 extends in engagement with the two pulleys 132,134, whereby rotation of the crankshaft 52 effectuates rotation of the camshaft 82.

The motor 20 includes a number of sub-systems relating to the engine 26. First, a lubricating system provides lubricant to one or more parts of the engine 26 for lubricating them. The lubricating system includes means for drawing lubricant from a lubricant supply and delivering it to the engine 26. In the embodiment illustrated, the supply is located in an oil pan 144 positioned below the engine 26 in the drive shaft housing 28.

Preferably, the means for delivering lubricant comprises an oil pump 140. Referring to FIGS. 4 and 5, the lubricant pump 140 is positioned below the engine 26 and is preferably driven by an end of the camshaft 82 extending below the engine. The pump 140 draws lubricant upwardly towards the engine 26 through a filtered inlet 146 positioned in the oil pan 144.

The pump 140 delivers lubricant from the supply through a filter 142. The lubricant then flows through one or more passages or galleries through the engine 26 for lubricating the various parts thereof, as well known to those of skill in the art. The lubricant preferably drains downwardly through one or more drain passages to the lubricant or oil pan 144 for re-delivery to the engine.

Referring to FIG. 3, an oil fill port 148 is preferably provided at the end of the engine 26 where the cylinder head 46 is positioned. The oil fill portion 148 is provided in communication with the oil pan 144 through the drain lines, whereby an operator of the motor 20 may add lubricant to the lubricating system.

Figure 6:
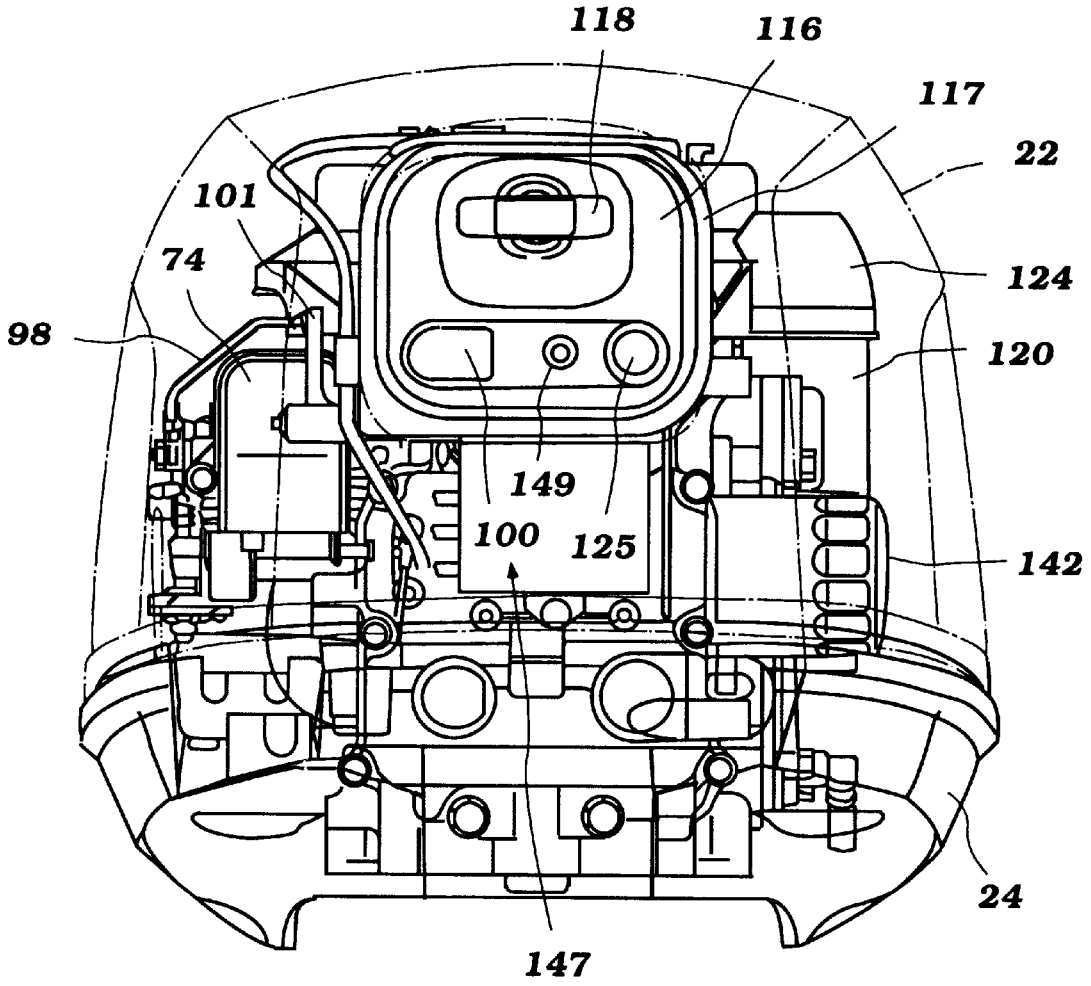
FIG. 6 is an end view of the engine powering the motor illustrated in FIG. 1, with a portion of the cowling enclosing the engine illustrated in phantom.

The lubricating system includes means for providing a warning of a lubricant system malfunction or undesirable condition. Referring to FIG. 6, a lubricant system warning lamp 149 is preferably provided on the mounting part 117 adjacent the handle 118 and starter button 125. The lamp 149 may be arranged to illuminate when a lubricant sensor indicates that the lubricant level in the pan 144 is low, or the lubricant pressure in the lubricant system is too low or too high, or when other similar undesirable lubricating system conditions arise as known to those of skill in the art.

This warning system may include electronics 147 which are mounted at the crankcase end of the engine 26 adjacent the starter motor 120. These electronics 147 may also include other electrical system components such as relays and the like which comprise portions of the starting, ignition or other systems.

A cooling system is provided for cooling one or more parts of the engine 26. The cooling system includes means for delivering coolant to the engine 26. Referring to FIG. 1, this means preferably comprises a coolant pump 150. The coolant pump 150 is positioned in the drive shaft housing 28 and driven by the drive shaft 58.

The coolant pump 150 draws water from the body of water in which the motor 20 is operating through an inlet 152 in the lower case 32 of the drive shaft housing 28. This coolant is delivered upwardly through the drive shaft housing 28 to the engine 26 through a coolant delivery line 156.

The coolant is delivered through one or more coolant passages or jackets, such as passages in the cylinder head 46 and block 48 and a passage 158 positioned adjacent a portion of the exhaust system, for cooling various parts of the engine 26. The coolant preferably drains through a drain line from the engine 26 into a coolant pool 162 located in the drive shaft housing 28. The coolant pool 162 is preferably positioned adjacent the oil pan 144 and separated from the second expansion chamber 111 by a dividing wall 164.

The coolant drains from the pool 162 (such as over an overflow weir, not shown) through a drain passage 166 to a discharge through the drive shaft housing 28 back to the body of water in which the motor 20 is operating.

The cooling system may be provided with one or more thermostats (not shown) of a type well known to those of skill in the art for use in controlling the flow of coolant through the engine 26. For example, a thermostat may be provided for limiting the flow of coolant through the engine 26 when the engine temperature is low, permitting the engine 26 to warm up.

The cooling system may also include a pressure relief valve (not shown) for diverting coolant from the cooling system in the event the pressure in the system exceeds a predetermined high pressure.

Referring to FIGS. 3 and 5, the engine 26 includes a crankcase pressure relief system. This system includes a crankcase breather element 170 which is connected to the crankcase cover 56. The element 170 has a passage therethrough which is in communication with the crankcase chamber and a by-pass line 172 leading to the intake system. The element 170 is preferably positioned at the top end of the engine 26 adjacent the flywheel 110, as best illustrated in FIG. 3.

The breather element 170 preferably includes a one-way valve which permits gas under high pressure in the crankcase to flow therethrough to the by-pass line 172, but which prevents the flow of gas into the crankcase chamber. The line 172 preferably comprises a hose which extends from the element 170 to the silencer 74.

The relief system works as follows. During the cylinder compression and combustion processes, some of the air and fuel charge passes between the exterior of the piston and the portion of the cylinder block 28 which defines the cylinder in which the piston 50 is moving. This gas raises the pressure in the crankcase, such that when the piston 50 moves downwardly, the high pressure in the crankcase makes more difficult the movement of the piston. As the pressure within the crankcase exceeds a predetermined level, gas is diverted through the element 170 to the air intake. This gas is then re-delivered to the engine 26 with air drawn into the silencer 74 from within the cowling 22.

A choke control is provided for actuating a choke valve associated with the intake system. The choke valve (not shown) is movably positioned in the intake pipe 76. Preferably, the choke valve is a butterfly-type plate which is movably positioned in that portion of the intake pipe 76 defined by the carburetor 94 and positioned upstream of the throttle valve. The choke valve is adapted to be moved to a generally closed position which restricts the air flow through the intake pipe 76 independent of the throttle valve, whereby when the engine 26 is cold, the ratio of fuel to air of the charge supplied to the engine 26 is increased. When the engine 26 is started and warms up, the choke valve is preferably moved to an open position in which air flows past the valve, with the air flow then controlled only by the throttle valve.

As illustrated, the choke control includes a choke actuator which controls the valve through a choke linkage. The linkage includes a choke lever 96 which is connected to the choke valve. For example, the choke valve may be connected to a rotating shaft which extends outwardly of the carburetor 94 with the lever 96 connected thereto. A choke lever or link 98 extends from the lever 96 in the direction of that end of the motor 20 which faces the watercraft 21 when connected thereto.

Figure 8:
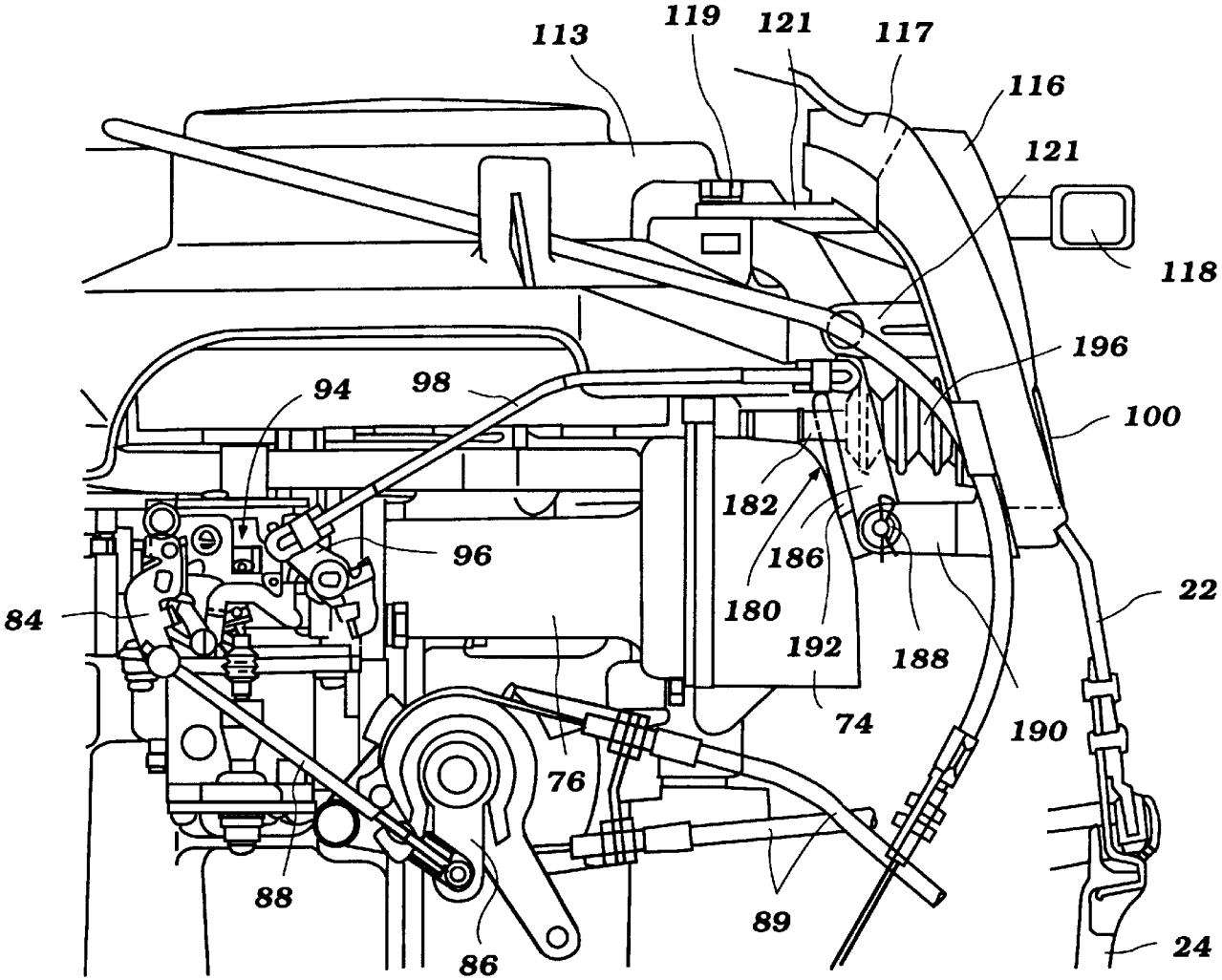
FIG. 8 is an enlarged view of a portion of the motor and engine illustrated in FIG. 5, illustrating the choke control of the present invention.
Figure 9:
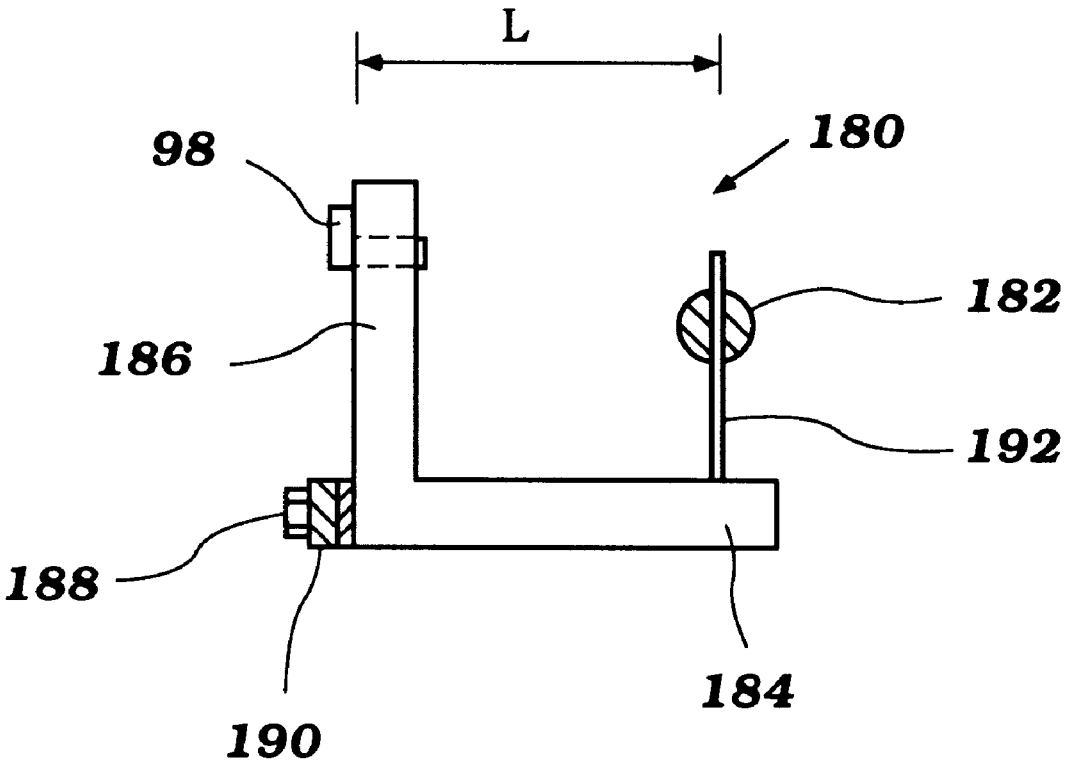
FIG. 9 is an end view of an offset link of the choke control of the present invention.

The choke lever 98 is connected to a choke control rod 182 through an offset connector 180. As best illustrated in FIG. 9, but also referring to FIGS. 7 and 8, the connector 180 has a first segment 184 which extends horizontally, and a second segment 186 connected thereto which extends generally perpendicular to the first segment, and thus vertically.

The connector 180 is preferably mounted to the main cowling 22 via a support 190 extending inwardly therefrom. The support 190 has a passage through which a pin 188 extending from the connector 180 passes. A cotter pin or other member is preferably used to lock the pin 188 to the support 190.

The choke link 98 is connected to a top end of the second segment 186 of the connector 180. The choke rod 182 is preferably mounted to a mount pin 192 extending upwardly from the first segment 184 of the connector 180 generally opposite the second segment 186. In this manner, the choke rod 182 is space from the choke lever 98 by an offset distance "L."

The choke rod 182 extends from the connector 180 through the combined guide and mount 116 adjacent the starter handle 118 to a choke actuator, preferably a choke knob 100. A flexible boot-type seal 196 is positioned over that portion of the rod 182 between the connector 180 and the inner side of the mount 116 from entering the cowling.

As illustrated, the choke control is positioned generally above the intake system of the engine 26. In particular, the choke lever 98 extends above the intake pipe 76 and silencer 74. On the other hand, the throttle control is preferably generally positioned below the intake system. In this manner, the choke and throttle controls may be positioned close to the engine 26 to reduce the total width of the engine and keep the width profile of the engine small.

At the same time, the choke control is arranged in a manner which permits the choke actuator 100 to be conveniently positioned at the end of the motor 20 adjacent the watercraft 21. Thus, the operator of the watercraft 21 can conveniently access the choke actuator 100 without leaning far out beyond the stern of the craft.

Of course, the foregoing description is that of preferred embodiments of the invention, and various changes and modifications may be made without departing from the spirit and scope of the invention, as defined by the appended claims.

What is claimed is:

1. An outboard motor having a cowling, a water propulsion device and a watercraft mount, an internal combustion engine positioned in said cowling and arranged to propel said water propulsion device, said engine having a top, a bottom, a first end at which is positioned a cylinder head and a second end at which is positioned a crankcase, first and second opposing sides between said ends, at least one combustion chamber, an intake system for providing air to said combustion chamber, said intake system including an intake pipe extending along said first side of said engine, a choke valve associated with said intake pipe, a mounting member associated with said cowling and positioned at an end thereof corresponding to said watercraft mount, and further including a choke control including a choke actuator supported by said mounting member and a link mechanism connecting said actuator to said choke valve, said link mechanism positioned in a space within said cowling towards said top of said engine above said intake pipe.

2. The outboard motor in accordance with claim 1, wherein a carburetor is positioned along said intake pipe and said choke valve is positioned in a passage through said carburetor.

3. The outboard motor in accordance with claim 2, wherein said carburetor includes a throttle valve and a throttle control is provided for moving said throttle valve, said throttle control including a throttle linkage connected to said throttle valve and extending generally towards said bottom of said engine below said intake pipe.

4. The outboard motor in accordance with claim 1, wherein said choke actuator comprises a knob.

5. The outboard motor in accordance with claim 1, wherein said link mechanism includes a choke rod extending from said actuator through said mounting member into said cowling to a connector and a choke lever extending from said connector to said choke valve.

6. The outboard motor in accordance with claim 5, wherein said choke rod and choke lever are offset along said connector.

7. The outboard motor in accordance with claim 1, wherein said motor includes a re-coil type starter for starting said engine, said starter including a starter handle supported by said mounting member.

8. The outboard motor in accordance with claim 5, further including a seal positioned over said choke rod between said connector and said mounting member.

9. A choke control for an outboard motor, the motor having a cowling and a water propulsion device, an engine positioned in said cowling and having an output shaft in driving relation with said water propulsion device, said engine defining at least one combustion chamber, an intake system providing air to said combustion chamber, said intake system including an intake pipe extending along a side of said engine and contained entirely within said cowling, a choke valve within said intake pipe for controlling the flow of air through said intake pipe, said choke control including a choke actuator positioned in substantial part external to said cowling at an end thereof facing a watercraft when said motor is connected thereto and having a portion extending into the interior of said cowling, said choke actuator being supported for reciprocation along an axis by said cowling and a choke linkage contained entirely within said cowling and extending from said actuator portion to said choke valve for transferring reciprocation of said choke actuator into rotation of said choke valve, whereby an operator of said motor may actuate said choke valve remotely from said choke actuator positioned external to said cowling.

10. The choke control in accordance with claim 9, wherein said choke actuator comprises a knob.

11. The choke control in accordance with claim 9, wherein a carburetor is positioned along said intake pipe and said choke valve is positioned in an intake passage through said carburetor.

12. The choke control in accordance with claim 9, wherein said output shaft of said engine is generally vertically extending and said engine has a top end, said choke linkage positioned between said top end of said engine and said intake pipe.

13. The choke control in accordance with claim 9, wherein said choke actuator is connected to a choke rod extending into said cowling, said choke rod connected to said choke linkage through an offset mechanism.

14. A choke control for an outboard motor, the motor having a cowling and a water propulsion device, an engine positioned in said cowling and having an output shaft in driving relation with said water propulsion device, said engine defining at least one combustion chamber, an intake system providing air to said combustion chamber, said intake system including an intake pipe extending along a side of said engine and contained entirely within said cowling, a choke valve within said intake pipe for controlling the flow of air through said intake pipe, said choke control including a choke actuator positioned in substantial part external to said cowling at an end thereof facing a watercraft when said motor is connected thereto and having a portion extending into the interior of said cowling and a choke linkage contained entirely within said cowling and extending from said actuator portion to said choke valve, whereby an operator of said motor may actuate said choke valve remotely from said choke actuator positioned external to said cowling, a starter having a handle supported by a mounting extending through said cowling, said choke actuator being supported by said mounting adjacent said handle.

15. The choke control in accordance with claim 14, further including an alarm element connected to said mounting.

* * * * *